US005288582A

United States Patent [19]

Contois et al.

[11] Patent Number: 5,288,582

[45] Date of Patent: Feb. 22, 1994

[54] PHOTOELECTROGRAPHIC METHOD FOR PRINTING

[75] Inventors: Lawrence E. Contois, Conesus; William Mey, Rochester, both of N.Y.

[73] Assignee: Eastman Kodak Company, Rochester, N.Y.

[21] Appl. No.: 741,295

[22] Filed: Jul. 29, 1991

[51] Int. Cl.[5] ..... G03G 13/22

[52] U.S. Cl. ..... 430/126; 430/31; 430/83

[58] Field of Search ..... 430/83, 49, 56, 61, 430/81, 82, 31, 126

[56] References Cited

U.S. PATENT DOCUMENTS

| | | | |
|---|---|---|---|
| 3,451,811 | 7/1969 | Brynko | 96/1 |
| 3,554,745 | 1/1971 | Van Allan | 96/1.6 |
| 3,577,235 | 5/1971 | Contois | 96/1.6 |
| 3,615,406 | 10/1971 | Merrill | 96/1.5 |
| 3,748,128 | 7/1973 | McNally | 96/1.4 |
| 3,879,197 | 4/1975 | Bartlett et al. | 96/1.4 |
| 3,912,509 | 10/1975 | Janssenes et al. | 96/1.5 |
| 3,982,935 | 9/1976 | Bartlett et al. | 96/1 R |
| 3,998,636 | 12/1976 | Van den Houte et al. | 96/1.4 |
| 4,283,475 | 8/1981 | Kawasura et al. | 430/70 |
| 4,421,837 | 12/1983 | Hiroshi et al. | 430/31 |
| 4,468,444 | 8/1984 | Contois | 430/72 |
| 4,633,260 | 5/1987 | Kitatani et al. | 430/83 |
| 4,661,429 | 4/1987 | Molaire et al. | 430/70 |
| 4,681,827 | 7/1987 | Franke et al. | 430/83 |
| 4,818,660 | 4/1989 | Blanchet-Fincher et al. | 430/281 |
| 4,859,551 | 8/1989 | Kempf | 430/49 |
| 5,240,800 | 8/1993 | Contois et al. | 430/51 |

FOREIGN PATENT DOCUMENTS

| | | |
|---|---|---|
| 56-8149 | 7/1979 | Japan . |
| 59-146059 | 2/1983 | Japan . |

OTHER PUBLICATIONS

Schein, "Electrophotography and Development Physics", Chpt. 2, pp. 26–32 (1988).

Research Disclosure, Disclosed by Peter M. Stacy and Richard Stahr "Method and apparatus for the production of multiplee prints from reusable conductivity photoconductor element", #12846, Dec. 1974.

*Primary Examiner*—Marion E. McCamish
*Assistant Examiner*—Rosemary Ashton
*Attorney, Agent, or Firm*—Willard G. Montgomery

[57] ABSTRACT

A photoelectrographic element for electrostatic imaging, containing a conductive layer and a photosensitive layer, is produced using photosensitive layer materials which form a barrier to charge injection where exposed to ultraviolet radiation. As a result, exposed areas can be charged, while unexposed portions cannot. The photosensitive layer contains an organic photoconductor, an ultraviolet radiation sensitizer, and, optionally, an organic binder. A method of forming images with this photoelectrographic element is also disclosed.

9 Claims, 1 Drawing Sheet

PHOTOELECTROGRAPHIC METHOD FOR PRINTING

FIELD OF THE INVENTION

The present invention relates to an ultraviolet radiation sensitive photoelectrographic master.

BACKGROUND OF THE INVENTION

Electrophotographic compositions and imaging processes are well known. In these processes an electrophotographic element having a layer containing a photoconductor is electrostatically charged and then imagewise exposed to form a latent electrostatic image. The latent electrostatic image is subsequently developed with a toner composition. Electrophotographic elements and processes are disclosed, for example, in U.S. Pat. Nos. 3,141,770 to Davis et al., 3,554,745 to Van Allen, 3,577,235 to Contois, 3,615,414 to Light et al., 4,442,193 to Chen et al., 4,421,837 to Hiroshi et al., and 4,468,444 to Contois. Unfortunately, with any electrophotographic element, it is always necessary to charge electrostatically and imagewise expose the charged element for each copy being made.

Multiple copies have been made from a single exposure using photoelectrographic elements in which a persistent differential conductivity pattern is created between exposed and unexposed portions. This allows for subsequent use of the element in printing multiple copies from a single exposure with only multiple charging, developing, transferring, and cleaning steps. This is different from electrophotographic imaging techniques where the electrophotographic element must generally be charged electrostatically followed by imagewise exposure for each copy produced.

Photoelectrographic masters are ideal for use in xeroprinting or multiple color proofing, because multiple high-quality prints can be produced rapidly in view of the need for only a single exposure. This is especially useful in making color images.

One type of master, disclosed in U.S. Pat. No. 4,818,660 to Blauchet-Fincher et al. and U.S. Pat. No. 4,859,551 to Kempf, is prepared by coating a photohardenable layer on an electrically conductive substrate and exposing the layer imagewise to light. Exposed portions of the photohardenable layer harden and become nonconductive, while the unexposed parts of the layer remain unhardened and conductive. When the master is electrostatically charged and developed by applying a toner of opposite charge, the toner adheres to exposed areas. Such films, however, are difficult to handle due to the tackiness of unhardened polymer.

Photoelectrographic master elements generally have a conductive layer in electrical contact with a film layer. When exposed to ultraviolet radiation, photochemically-generated charges form in the film, making the film conductive, while unexposed areas of the film remain insulating. When the element is charged, charges at the surface of the element and at the interface between the film and the conductive layers are neutralized where exposure has occurred. Unexposed areas, however, are charged and then developed with toner. The toned image is transferred to a receptor sheet.

In U.S. Pat. No. 4,661,429 to Molaire et al., the film layer includes an aromatic onium salt or a 6-substituted-2,4-bis (trichloromethyl)-5-triazine acid photogenerator, an insulating binder, and, optionally, a sensitizer. U.S. Pat. Nos. 3,879,197 and 3,982,935 to Bartlett et al.

describe a photoelectrographic element with a layer containing a binder and organic halogen compounds, capable of forming hydrohalide acids upon illumination with light, in combination with certain organic compounds. U.S. Pat. No. 3,998,636 to Van den Houte, et al. describes an electrostatic printing master in which the recording layer comprises a mixture of an organic polyhalogen compound, a vinylcarbazole copolymer, and an anilide sensitizer which increases the conductivity of the layer on exposure. Research Disclosure 12846 (December 1974) to Peter M. Stacy et al. utilizes a photoconductive composition containing triarylamine type photoconductors, polyester binders, and sensitizers. The photoelectrographic element of U.S. Pat. No. 3,451,811 to Brynko utilizes the photochromic properties (i.e., photo-isomerization) of spirobenzopyrans. U.S. Pat. No. 3,748,128 to McNally describes a layer containing heterocyclic nuclei which, when exposed, form a latent image with changed triboelectric properties suitable for development with a toner. Such films are, however sensitive to humidity, which causes unexposed areas to become more conductive as humidity decreases.

SUMMARY OF THE INVENTION

The present invention relates to a photoelectrographic element for electrostatic imaging utilizing a photosensitive layer which forms a barrier to charge injection in portions of the layer exposed with ultraviolet radiation but not in unexposed portions. This permits the formation of an electrostatic latent image on the element by applying a charge to the entire surface of the element.

This effect can be achieved with either positive or negative corona charging provided that the element has both a conductive layer capable of injecting an opposite charge and a photosensitive layer which can transport the charge to neutralize the corona charge absent exposure. When utilizing a negative corona charge, the conductive layer should have a work function energy greater than the oxidation potential of the photosensitive layer constituents. For positive charging, the reduction potential of the photosensitive layer should be greater than the work function energy of the conductive layer materials. Once exposed, a barrier to further charge injection is created. As a result, the surface of the element can be repeatedly charged and toned to produce multiple copies from a single exposure. This is exactly opposite the effect achieved by prior art photoelectrographic processes. For example, in U.S. Pat. No. 4,661,429 to Molaire et al., the conductive and acid generating layers of the photoelectrographic element are formed from materials which cause unexposed areas to charge, while exposed areas remain uncharged.

The photosensitive layer of the present invention is free of photopolymerizable material and is in electrical contact with the conductive layer. The photosensitive layer contains an organic photoconductor and an ultraviolet radiation sensitizer. Unless the photoconductor is polymeric, the photosensitive layer should also contain an organic binder.

Photoelectrographic elements in accordance with the present invention can be produced either to accept positive or negative corona charging. While not wishing to be bound by theory, it is believed that in this embodiment, ultraviolet radiation exposure creates traps for either positive or negative charges in the photosensitive layer. The presence of such traps prevents charge injection and permits exposed portions of the element to undergo negative or positive charging.

The present invention also provides a photoelectrographic imaging method which utilizes the above-described photoelectrographic element. This process comprises the steps of: exposing the photosensitive layer imagewise to ultraviolet radiation (having a wavelength of 250 to 450 nm) without prior charging to create a latent conductivity pattern and printing by a sequence comprising: charging to create an electrostatic latent image, developing the electrostatic latent image with charged toner particles, transferring the toned image to a suitable receiver, and cleaning any residual, untransferred toner from the photoelectrographic element.

DETAILED DESCRIPTION OF THE DRAWINGS

Figure 1A:
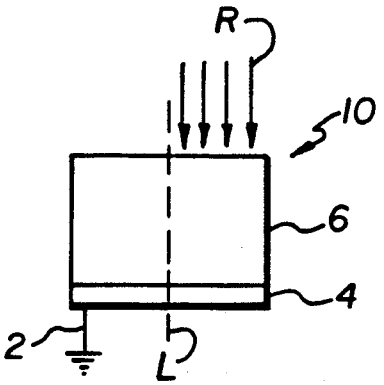
FIGS. 1A, 1B, 1C, and 1D show the photoelectrographic process sequence of the present invention.

As already noted, the present invention relates to a photoelectrographic element for electrostatic imaging having a conductive layer on a support layer and a photosensitive layer which is free from photopolymerizable materials and is in electrical contact with the conductive layer. The photosensitive layer contains an organic photoconductor, an ultraviolet radiation sensitizer and, unless the organic photoconductor is polymeric, an organic binder. These materials are selected so that the photosensitive layer forms a barrier to charge injection after exposure with ultraviolet radiation. As a result, exposed areas of the photoelectrographic element can be charged, while unexposed parts cannot.

Useful conducting layers include any of the electrically conducting layers and supports used in electrophotography. These include, for example, paper (at a relative humidity above about 20 percent); aluminum paper laminates; metal foils, such as aluminum foil, zinc foil, etc.; metal plates, such as aluminum, copper, gold, zinc, brass, nickel, indium, magnesium, alloys thereof, and galvanized plates; regenerated cellulose and cellulose derivatives; certain polyesters, especially polyesters having a thin electroconductive layer (e.g., cuprous iodide or indium tin oxide) coated thereon; etc.

While the photosensitive layers of the present invention can be affixed, if desired, directly to a conducting substrate or support, it may be desirable to use one or more intermediate subbing layers between the conducting layer or substrate and the photosensitive layer to improve adhesion.

Such subbing layers, if used, typically have a dry thickness in the range of about 0.1 to about 5 μm. Useful subbing layer materials include film-forming polymers such as cellulose nitrate, polyesters, copolymers or poly(vinyl pyrrolidone) and vinylacetate, and various vinylidene chloride-containing polymers including two, three and four component polymers prepared from a polymerizable blend of monomers or prepolymers containing at least 60 percent by weight of vinylidene chloride. Other useful subbing materials include the so-called tergels which are described in U.S. Pat. No. 3,501,301 to Nadeau et al.

Optional overcoat layers are useful with the present invention, if desired. For example, to improve surface hardness and resistance to abrasion, the surface layer of the photoelectrographic element of the invention may be coated with one or more organic polymer coatings or inorganic coatings. A number of such coatings are well known in the art, and, accordingly, an extended discussion thereof is unnecessary. Several such overcoats are described, for example, in *Research Disclosure*, "Electrophotographic Elements, Materials, and Processes", Vol. 109, Page 63, Paragraph V, May, 1973, which is incorporated herein by reference.

The organic photoconductor can be triarylmethanes, diarylsulfones, alkylsulfones, and triarylamines. Particularly preferred organic photoconductors are 1,1,5,5-tetra(4-diethylamino-2-methylphenyl)pentane and 4,4',4'',4'''-(1,4-phenylenedimethylidene)tetrakis (N-benzyl-N-ethyl-3-methylbenzeneamine).

The ultraviolet radiation sensitizer may be any of the following: xanthones, indandiones, indanones, throxanthones, acetophenones, benzophenones, anthracenes, dialkoxyanthracenes, perylenes, pyryliums, phenothiazines, and pyrenes. Particularly preferred ultraviolet radiation sensitizers are 4-N-Butylamino-2-(4-methoxyphenyl) benzo(b)pyrylium tetra-fluoroborate or N,N-Bis [p-(n-butyl)phenyl]-1,4, 5,8-napthalene bis-dicarboximide. Such sensitizers are selected to absorb ultraviolet radiation and to interact with other materials in the photosensitive layer to form charge traps.

Unless the organic photoconductor is a polymeric material, the photosensitive layer should also contain an organic binder. Suitable binder materials are polymers such as polycarbonates, polyesters, polyolefins, phenolic resins, and the like. Desirably, the binders are film forming. Such polymers should be capable of supporting an electric field in excess of $1\times10^5$ V/cm and exhibit a low dark decay of electrical charge.

Preferred binders are styrene-butadiene copolymers; silicone resins; styrene-alkyd resins; soya-alkyd resins; poly(vinyl chloride); poly(vinylidene chloride); vinylidene chloride, acrylonitrile copolymers; poly(vinyl acetate); vinyl acetate, vinyl chloride copolymers; poly(vinyl acetyls), such as poly(vinyl butyral); polyacrylic and methacrylic esters, such as poly(methyl methacrylate), poly(n-butyl methacrylate), poly(isobutyl methacrylate), etc; polystyrene; nitrated polystyrene; poly(vinylphenol)polymethylstyrene; isobutylene polymers; polyesters, such as phenol formaldehyde resins; ketone resins; polyamides; polycarbonates; etc. Methods of making resins of this type have been described in the prior art, for example, styrene-alkyd resins can be prepared according to the method described in U.S. Pat. Nos. 2,361,019 and 2,258,423. Suitable resins of the type contemplated for use in the photoactive layers of this invention are sold under such tradenames as Vitel PE 101-X, Cymac, Piccopale 100, Saran F-220. Other types of binders which can be used include such materials as paraffin, mineral waxes, etc. Particularly preferred binders are aromatic esters of polyvinyl alcohol polymers and copolymers, as disclosed in pending U.S. patent application Ser. No. 509,119, now U.S. Pat. No. 5,108,859 entitled "Photoelectrographic Elements". One example of such a polymer is poly (vinyl m-bromo-benzoate-co-vinyl acetate).

Other particularly preferred materials are poly[(2,2-dimethyl-1,3-propylene-co-ethylene terephthalate)], poly [(4,4'-hexahydro-4,7-methanoldene-5-ylidene)-bisphenoxyethylene-co-ethylene terephthalate, and mixtures thereof.

Where the photosensitive layer includes an organic binder, this layer contains 15% to 40% organic photoconductor, 0.2% to 5% ultraviolet radiation sensitizer, and 55% to 85% organic binder. In the absence of an organic binder, the photosensitive layer includes 94% to 99.8% polymeric organic photoconductor and 0.2% to 6% ultraviolet radiation sensitizer.

Typically, the conductive layer of the photoelectrographic element of the present invention is 0.1 to 2 μm, preferably 0.5 μm thick. The photosensitive layer has a layer thickness of 5 to 20 μm, preferably 10 μm.

In preparing photosensitive layers, the organic photoconductor, the ultraviolet radiation sensitizer, and, if present, the organic binder are dissolved in a suitable solvent. Solvents of choice for preparing coatings include a number of solvents including aromatic hydrocarbons such as toluene; ketones, such as acetone or 2-butanone; esters, such as ethyl acetate or methyl acetate chlorinated hydrocarbons such as ethylene dichloride, trichloroethane, and dichloromethane, ethers such as tetrahydrofuran; or mixtures of these solvents.

The photosensitive layers are coated on a conducting support in any well-known manner such as by doctor-blade coating, swirling, dip-coating, and the like.

The photoelectrographic elements of the present invention are employed in the photoelectrographic process, described below with reference to FIGS. 1A–1D. This process involves a 2-step sequence—i.e., an exposing phase followed by a printing phase.

In the exposing phase, shown in FIG. 1A, the portion of photosensitive layer 6 to the right of line L is exposed imagewise to ultraviolet radiation R without prior charging to create a latent pattern in element 10. Element 10 is then ready to be subjected to the printing phase either immediately or after some period of time has passed.

Figure 1B:
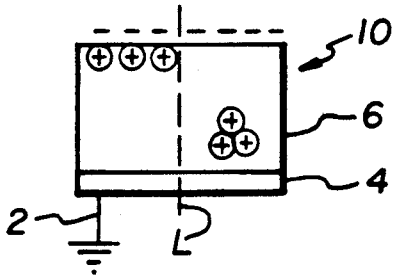

In the printing phase, element 10 is given a blanket electrostatic charge by placing it under a corona discharge (not shown). While not wishing to be bound by theory, it is believed that in exposed areas (i.e., to the right of line L) charges (i.e., positive charges in this embodiment) initially injected from conductive layer 4, attached to ground 2, are immediately trapped within photosensitive layer 6, as shown in FIG. 1B. The trapped charges block any further injection of charge. As a result, exposed portions of element 10 can be charged (negatively in this embodiment) at the surface of photosensitive layer 6, creating an electrostatic latent image. In unexposed portions of element 10 (i.e., to left of line L), positive charges (i.e., holes) travel from conductive layer 4 to the surface of photosensitive layer 6, neutralizing negative charges at this location.

Figure 1C:
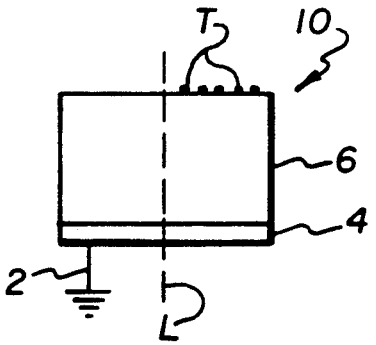
Figure 1D:
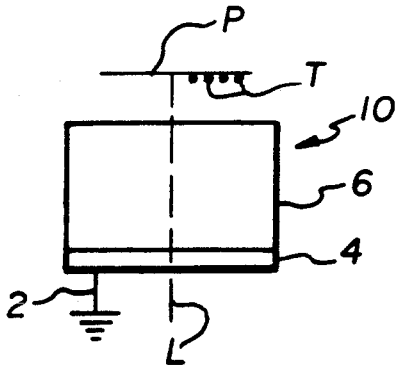

After charging, the electrostatic latent image is developed with charged toner particles T, as shown in FIG. 1C. In this case, exposed area development is utilized; however, it is instead also possible to develop charged areas. In either case, appropriate toners well known in the art can be utilized. The toned image is transferred to receiver P (e.g., paper), as shown in FIG. 1D. The toner particles can be fused either to a material (e.g , paper) on which prints are actually made or to an element to create an optical master or a transparency for overhead projection. Any residual, untransferred toner is then cleaned away so that the above-described printing phase can be repeated. By this process, multiple prints from a single exposure can be prepared by subjecting photoelectrographic element 10 only once to the exposing phase, as shown in FIG. 1A, and then subjecting element 10 to the printing phase once for each print made, as shown in FIGS. 1B to 1D.

The toner particles are in the form of a dust, a powder, a pigment in a resinous carrier, or a liquid developer in which the toner particles are carried in an electrically insulating liquid carrier. Methods of such development are widely known and described as, for example, in U.S. Pat. Nos. 2,296,691, 3,893,935, 4,076,857, and 4,546,060.

Developing can be carried out with a charged toner having the same polarity as the latent electrostatic image or with a charged toner having a polarity different from the latent electrostatic image. In one case, a positive image is formed. In the other case, a negative image is formed.

One type of photoelectrographic element in accordance with the present invention is charged negatively, as shown in FIG. 1B. However, other elements, also encompassed by this invention, may instead be charged positively.

To enable the photoelectrographic element of the present invention to be charged where exposed but not where unexposed, it is necessary to form the conductive layer and the photosensitive layer from materials which will permit charge injection and transport absent exposure and prevent such injection and transport after exposure. Generally, this is achieved by selecting conductive layer materials and photosensitive layer constituents which have favorable differences in energy levels absent exposure. For the conductive layer, this energy level is measured in terms of work function. As to the photosensitive layer, the oxidation/reduction potential of the organic photoconductor is utilized. Specifically, the oxidation potential is relevant for negative charging, while the reduction potential must be considered for positive charging. When utilizing a negative corona charge, the work function energy of the conductive layer constituents is greater than the photosensitive layer oxidation potential. For positive charging, the reduction potential of the photosensitive layer components is greater than the work function energy of the conductive layer materials. Once exposed, a barrier to further charge injection is created. Such work function and oxidation/reduction potential values are available from a variety of sources, including U.S. Pat. Nos. 4,885,211 to Tang et al. and 4,514,481 to Scozzafava et al.

For example, an indium conductive layer has a work function of +5.5–6.0 electron volts, while a photosensitive layer with tri-para-tolylamine organic photoconductor has an oxidation potential of +0.81 volts. The oxidation potential can be converted from the electrochemical scale to the vacuum scale by adding 4.5 to the +0.81 volt value. Thus, the indium conductive layer has a work function (i.e. +5.5 to 6.0 electron volts) greater than the oxidation potential of the tri-para-tolylamine organic photoconductor (i.e. +5.31 electron volts). As a result, a photoelectrographic element formed with such layers can achieve charge injection. Further selection of an appropriate ultraviolet radiation sensitizer permits the element to be exposed and negatively charged, as shown in FIGS. 1A to 1D.

For positive charging, a magnesium-aluminum alloy (in a 10:1 magnesium to aluminum ratio), having a work function of +.5 to 4.0 electron volts, can be utilized as the conductive layer and an organic photoconductor made from diphenylsulfone, having a reduction potential of −0.13 volts, can be employed. Converting the latter value to the vacuum scale yields a reduction potential of 4.37 electron volts. Since this reduction potential is greater than the work function value of the conductive layer, a photoelectrographic element with such layers can be exposed and positively charged in accordance with the present invention.

The following examples are provided to illustrate the usefulness of the photoelectrographic element of the present invention and are by no means intended to exclude the use of other elements which fall within this disclosure.

EXAMPLES

Example 1

A CuI containing conductive layer, coated at 30 mg/ft$^2$ on a polyester support, is coated with the following composition to achieve a coverage of 1.05 gm/ft$^2$:

| | |
|---|---|
| Poly[(4,4'-hexahydro-4,7-methanoldene-5-ylidene)-bisphenoxyethylene-co-ethylene terephthalate | 79.60 g |
| Bisphenol-A-polycarbonate | 11.40 g |
| 1,1,5,5-tetra(4-diethylamino-2-methylphenyl) pentane | 49.00 g |
| 4-N-Butylamino-2-(4-methoxyphenyl)-benzo(b)pyrylium tetrafluoroborate | 2.80 g |
| Polymethylphenylsiloxane having a 23:1 methyl to phenyl ratio | 0.25 g |

The resulting film was then subjected to a 300 second UV exposure through a continuous tone stepwedge with 0.30 optical density steps, ranging from 0 to 2.3. The film was then mounted on a linear electrographic breadboard and corona charged with a grid-controlled charger having a grid potential set at −500 volts. The surface potential of exposed areas was measured at 1, 15, and 45 seconds after charging, and those values were subtracted from the potential in unexposed areas (i.e., 500 volts). As a result, Delta V's (i.e., potential differences in volts) between such unexposed and exposed areas of 180 (1 sec), 150 (15 sec), and 100 (45 sec) were detected.

Another sample of the film was corona charged with a grid potential set to +500 volts. When the surface measurements were repeated, a very small response occurred 1 second after charging, but at longer times a pattern was seen. These results demonstrate that this type of film is more effectively charged negatively.

Another sample of the film was given a 480 second ultraviolet radiation exposure and then electrically tested on an electrographic drum breadboard that operated at a machine speed of 10 inches/sec. This machine was equipped with a corona charger, development and toner transfer stations, and a film cleaning station. After UV exposure, the photoelectrographic master was mounted on this machine and its electrical properties were measured by corona charging the film negatively and measuring the difference in surface potential between the exposed and unexposed areas of the film. The film had a delta V of greater than 300 volts, and, after one day, the master was again tested on the breadboard device and found to have essentially the same Delta V. This shows that the film has excellent memory retention.

Example 2

Using the process of Example 1, a film was formed from the following composition:

| | |
|---|---|
| Poly[(4,4'-hexahydro-4,7-methanoldene-5-ylidene)-bisphenoxyethylene-co-ethylene terephthalate] | 63.70 g |
| Poly(oxycarbonyloxy-1,4-phenylene (-1-methylidene)-1,4-phenylene) | 27.30 g |
| 1,1,5-tetra(4-diethylamino-2-methylphenyl) pentane | 49.00 g |
| 4-N-Butylamino-2-(4-methoxyphenyl)benzo (b)pyrylium | 2.80 g |
| Polymethylphenylsiloxane having a 23:1 methyl to phenyl ratio | 0.25 g |

When this film was tested in the manner described in Example 1, Delta V's (in volts) of 20 (1 sec), 55 (15 sec), and 70 (45 sec) were measured.

Example 3

Using the process of Example 1, a film of the following composition was prepared:

| | |
|---|---|
| Poly[(4,4'-hexahydro-4,7-methanoldene-5-ylidene)-bisphenoxyethylene-co-ethylene terephthalate] | 58.80 g |
| Poly(oxycarbonyloxy-1,4-phenylene (-1-methylidene)-1,4-phenylene) | 25.20 g |
| 1,1,5-tetra(4-diethylamino-2-methylphenyl) pentane | 56.00 g |
| 4-N-Butylamino-2-(4-methoxyphenyl)benzo (b)pyrylium | 2.80 g |
| Polymethylphenylsiloxane having a 23:1 methyl to phenyl ratio | 0.25 g |

When this film was tested, as described in Example 1, Delta V's (in volts) of 45 (1 sec), 130 (15 sec), and 130 (45 sec) were measured.

Example 4

Using the process of Example 1, a film of the following composition was prepared:

| | |
|---|---|
| Poly(vinyl-bromobenzoate)-co-(vinyl acetate) | 101.60 g |
| Poly[(2,2-diemethyl-1,3-propylene-co-ethylene terephthalate)] | 13.90 g |
| 1,1,5-tetra(4-diethylamino-2-methylphenyl) pentane | 34.50 g |
| 4-N-Butylamino-2-(4-methoxyphenyl)benzo (b)pyrylium | 3.00 g |
| Polymethylphenylsiloxane having a 23:1 methyl to phenyl ratio | 0.25 g |

When this film was tested, as described in Example 1, Delta V's (in volts) of 90 (1 sec), 50 (15 sec), and 30 (45 sec) were measured.

Example 5

The film of Example 3 was prepared using N,N-Bis[p-(n-butyl)phenyl]-1,4,5,8-napthalene bis-dicarboximide as the ultraviolet radiation sensitizer. This film was tested, as described in Example 1, and Delta V's (in volts) of 10 (1 sec), 10 (15 sec), and 10 (45 sec) were measured.

Example 6

The film of Example 4 was prepared using N,N-Bis[p-(n-butyl)phenyl]-1,4,5,8-naphthalene bis-dicarboximide as the ultraviolet radiation sensitizer. When this sample was tested, as described in Example 1, Delta V's (in volts) of 90 (1 sec), 80 (15 sec), and 70 (45 sec) were measured.

Although the invention has been described in detail for the purpose of illustration, it is understood that such detail is solely for that purpose, and variations can be made therein by those skilled in the art without departing from the spirit and scope of the invention which is defined by the following claims.

What is claimed:

1. A photoelectrographic method for printing using a photoelectrographic element comprising:

a conductive layer and a photosensitive layer, which is free of photopolymerizable materials and is in electrical contact with said conductive layer, comprising:

an organic photoconductor and an ultraviolet radiation sensitizer, wherein said method comprises:

exposing said element to ultraviolet radiation without prior charging to create a barrier to charge injection in exposed portions of said photosensitive layer but not in unexposed portions thereof, and printing an image from said exposed element, said printing comprising:

charging said element, whereby exposed portions of said element are charged, while unexposed portions are not charged to form an electrostatic latent image on said element;

developing the electrostatic latent image by applying charged toner particles to said element to produce a toned image; and transferring the toned image to a suitable receiver, wherein said printing is carried out one time for each print made.

2. A method according to claim 1, wherein the organic photoconductor is selected from the group consisting of triarylamines, diarylsulfones, alkylsulfones, and triarylmethanes.

3. A method according to claim 1, wherein said photosensitive layer further comprises:

an organic binder selected from the group consisting of polycarbonates, polyesters, polyolefins, phenolic resins, paraffins, mineral waxes, and mixtures thereof.

4. A method according to claim 1, wherein the ultraviolet radiation sensitizer is selected from the group consisting of xanthones, indandiones, indanones, throxanthones, acetophenones, benzophenones, anthracenes, dialkoxyanthracenes, perylenes, phenothiazines, pyryliums, and pyrenes.

5. A method according to claim 1, wherein the conductive layer comprises a cuprous iodide layer coated on a polymeric substrate.

6. A method according to claim 1 further comprising:

cleaning any residual toner particles not transferred to the receiver from said element for each print made.

7. A method according to claim 1, wherein the receiver is a substrate for permanently receiving a toned image as a print.

8. A method according to claim 1, wherein said charging is with a charge of positive polarity.

9. A method according to claim 1, wherein said charging is with a charge of negative polarity.

* * * * *